US011230307B2

(12) United States Patent
Specht et al.

(10) Patent No.: US 11,230,307 B2
(45) **Date of Patent: *Jan. 25, 2022**

(54) RAILROAD VIRTUAL TRACK BLOCK SYSTEM

(71) Applicant: BNSF Railway Company, Fort Worth, TX (US)

(72) Inventors: Jerry Wade Specht, Lenexa, KS (US); Ralph E. Young, Osawatomie, KS (US); Kent Robert Shue, Bonner Springs, KS (US); Mitchell Wayne Beard, Shawnee, KS (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/302,524

(22) Filed: May 5, 2021

(65) Prior Publication Data

US 2021/0253147 A1 Aug. 19, 2021

Related U.S. Application Data

(60) Continuation of application No. 17/247,303, filed on Dec. 7, 2020, which is a division of application No.
(Continued)

(51) Int. Cl.
*B61L 1/18* (2006.01)
*B61L 11/08* (2006.01)
(Continued)

(52) U.S. Cl.
CPC ..... *B61L 11/08* (2013.01); *B61L 1/188* (2013.01); *B61L 7/088* (2013.01); *B61L 21/10* (2013.01);
(Continued)

(58) Field of Classification Search
CPC .... B61L 11/08; B61L 1/188; B61L 2011/086; B61L 21/10; B61L 23/044; B61L 23/168;
(Continued)

(56) References Cited

U.S. PATENT DOCUMENTS 5,332,180 A * 7/1994 Peterson ..... B61L 23/047 246/3
5,398,894 A 3/1995 Pascoe
(Continued)

FOREIGN PATENT DOCUMENTS

EP 0638469 A3 7/1997
WO 2015180902 A1 12/2015

OTHER PUBLICATIONS

International Search Report and Written Opinion regarding Application No. PCT/US2018/030325; dated Aug. 6, 2018; 1 page.

*Primary Examiner* — Mark T Le
(74) *Attorney, Agent, or Firm* — Enrique Sanchez; Whitaker Chalk Swindle & Schwartz, PLLC

(57) ABSTRACT

A method of railroad track control includes partitioning a physical track block into a plurality of virtual track blocks, the physical track block defined by first and second insulated joints disposed at corresponding first and second ends of a length of railroad track. The presence of an electrical circuit discontinuity in one of the plurality of virtual track blocks; is detected and in response a corresponding virtual track block position code indicating the presence of the discontinuity in the one of the plurality of virtual track blocks is generated.

16 Claims, 5 Drawing Sheets

Related U.S. Application Data

15/965,680, filed on Apr. 27, 2018, now Pat. No. 10,894,550.

(60) Provisional application No. 62/502,224, filed on May 5, 2017.

(51) Int. Cl.

| | |
|---|---|
| ***B61L 7/08*** | (2006.01) |
| ***B61L 21/10*** | (2006.01) |
| ***B61L 23/16*** | (2006.01) |
| *B61L 3/22* | (2006.01) |
| *B61L 23/04* | (2006.01) |

(52) U.S. Cl.

CPC ..... *B61L 23/168* (2013.01); *B61L 3/221* (2013.01); *B61L 23/044* (2013.01); *B61L 2011/086* (2013.01)

(58) Field of Classification Search

CPC ..... B61L 3/221; B61L 7/088; B61L 1/181; B61L 1/185; B61L 25/023; B61L 27/00; B61L 1/18; B61L 3/10; B61L 3/246

See application file for complete search history.

(56) References Cited

U.S. PATENT DOCUMENTS

| | | | | |
|---|---|---|---|---|
| 5,950,966 | A | 9/1999 | Hungate et al. | |
| 6,666,411 | B1 | 12/2003 | Hart et al. | |
| 9,102,341 | B2 | 8/2015 | Malone, Jr. et al. | |
| 10,894,550 | B2 * | 1/2021 | Specht | B61L 7/088 |
| 2003/0112131 | A1 | 6/2003 | McAllister | |
| 2005/0075765 | A1 * | 4/2005 | Oguma | B61L 1/188 701/19 |
| 2013/0218375 | A1 * | 8/2013 | Ning | B61L 27/0038 701/19 |
| 2013/0284859 | A1 | 10/2013 | Polivka et al. | |
| 2013/0334373 | A1 | 12/2013 | Malone, Jr. et al. | |
| 2014/0014782 | A1 | 1/2014 | Grappone | |
| 2016/0107664 | A1 * | 4/2016 | Kull | B61L 23/044 246/121 |

* cited by examiner

RAILROAD VIRTUAL TRACK BLOCK SYSTEM

CROSS-REFERENCE TO RELATED APPLICATIONS

The present application is a Continuation Application of U.S. patent application Ser. No. 17/247,303, filed Dec. 7, 2020, which is a Divisional Application of U.S. patent application Ser. No. 15/965,680, filed Apr. 27, 2018, which claims the benefit of U.S. Provisional Application Ser. No. 62/502,224, filed May 5, 2017, all of which are incorporated herein in their entireties for all purposes.

FIELD OF INVENTION

The present invention relates in general to railroad signaling systems and in particular to a railroad virtual track block system.

BACKGROUND OF INVENTION

Block signaling is a well-known technique used in railroading to maintain spacing between trains and thereby avoid collisions. Generally, a railroad line is partitioned into track blocks and automatic signals (typically red, yellow, and green lights) are used to control train movement between blocks. For single direction tracks, block signaling allows to trains follow each other with minimal risk of rear end collisions.

However, conventional block signaling systems are subject to at least two significant disadvantages. First, track capacity cannot be increased without additional track infrastructure, such as additional signals and associated control equipment. Second, conventional block signaling systems cannot identify broken rail within an unoccupied block.

SUMMARY OF INVENTION

The principles of the present invention are embodied in a virtual "high-density" block system that advantageously increases the capacity of the existing track infrastructure used by the railroads. Generally, by dividing the current physical track block structure into multiple (e.g., four) segments or "virtual track blocks", train block spacing is reduced to accurately reflect train braking capabilities. In particular, train spacing is maintained within a physical track block by identifying train position with respect to virtual track blocks within that physical track block. Among other things, the present principles alleviate the need for wayside signals, since train braking distance is maintained onboard the locomotives instead of through wayside signal aspects. In addition, by, partitioning the physical track blocks into multiple virtual track blocks, broken rail can be detected within an occupied physical track block.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
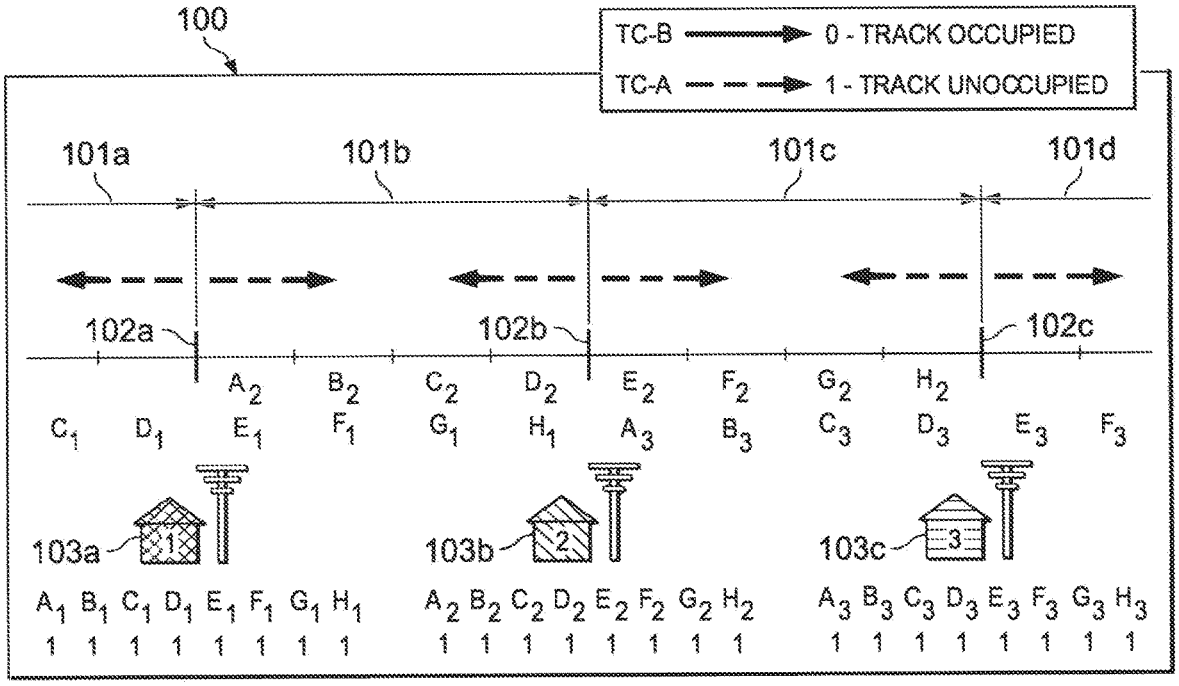
FIG. 1 is a diagram showing a representative number of unoccupied physical railroad track blocks, along with associated signaling (control) houses, with each physical track block partitioned into a selected number of virtual track blocks according to the principles of the present invention.

The principles of the present invention and their advantages are best understood by referring to the illustrated embodiment depicted in FIGS. 1-8 of the drawings, in which like numbers designate like parts.

Two methods of train detection are disclosed according to the present inventive principles. One method determines rail integrity in an unoccupied block. The second method determines train positioning within an occupied block in addition to rail integrity. The following discussion describes these methods under three different exemplary situations: (1) the system at rest (no trains) within the physical track block; (2) operation with a single train within the physical track block; (3) and operation with multiple trains within the physical track block. In this discussion, Track Code A (IC-A) is the available open sourced Electrocode commonly used by the railroads and is carried by signals transmitted via at least one of the rails of the corresponding physical track block. Track Code B (TC-B) is particular to the present principles and provides for the detection of train position within one or more virtual track blocks within an occupied physical track block and is preferably carried by signals transmitted via at least one of the rails of the corresponding physical track block. TC-A and TC-B may by carried by the same or different electrical signals. Preferably, either TC-A or TC-B is continuously transmitted. Generally, TC-A is dependent on a first location sending a coded message to a second location and vice versa (i.e., one location is exchanging information via the rail). On the other hand, TC-B is implemented as a reflection of the transmitted energy using a transceiver pair with separate and discrete components. With TC-B, the system monitors for reflections of the energy through the axle of the train.

A Virtual track block Position (VBP) message represents the occupancy data, determined from the TC-A and TC-B signals and is transmitted to the computers onboard locomotives in the vicinity, preferably via a wireless communications link. The following discussion illustrates a preferred embodiment and is not indicative of every embodiment of the inventive principles. TC-A is preferably implemented by transmitter-receiver pairs, with the transmitter and receiver of each pair located at different locations. TC-B is preferably implemented with transmitter-receiver pairs, with the transmitter and receiver of each pair located at the same location. The signature of the energy from the transmitter is proportional to the distance from the insulated joint to the nearest axle of the train.

The section of track depicted in FIGS. 1-8 represents physical track blocks 101*a*-101*d*, with physical track blocks 101*a* and 101*d* partially shown and physical track blocks 101*b* and 101*c* shown in their entirety. Physical track blocks 101*a*-101*d* are separated by conventional insulated joints 102*a*-102*c*. Signal control houses 103*a*-103*c* are associated with insulated joints 102*a*-102*c*. Each signaling house 103 preferably transmits on the track on both sides of the corresponding insulated joint 102, as discussed further below.

As indicated in the legends provided in FIGS. 1-8, solid arrows represent track code transmission during track occupancy by a train using TC-B signals. Dashed arrows represent track code transmission during unoccupied track using TC-A signals.

According to the present invention, each physical track block 101*a*, 101*d* is partitioned into multiple virtual track blocks or "virtual track blocks". In the illustrated embodiment, these virtual track blocks each represent one-quarter (25%) of each physical track block 101*a*-101*d*, although in alternate embodiments, the number of virtual track blocks per physical track block may vary. In FIGS. 1-8, house #1 (103*a*) is associated with virtual track blocks A1-H1, house #2 (103*b*) is associated with virtual track blocks A2-Hz, and house #3 (103*c*) is associated with virtual track blocks A3-H3. In other words, in the illustrated embodiment, each house 103 is associated with four (4) virtual track blocks to the left of the corresponding insulated joint 102 (i.e., virtual track blocks A, -$D_1$) and four (4) virtual track blocks to the right of the corresponding insulated joint 102 (i.e., virtual track blocks $E_1$-$H_1$). In this configuration, virtual track blocks overlap (e.g., virtual track blocks $E_1$-$H_1$ associated with house #1 overlap with virtual track blocks $A_2$-$D_2$ associated with house #2).

FIG. 1 depicts the track section with no trains in the vicinity. At this time, TC-A is transmitted from house #1 (103*a*) and received by house #2 (103*b*), and vice versa. The same is true for house #2 (103*b*) and house #3 (103*c*). All three locations generate and transmit a VBP message of 11111111 equating to track unoccupied in the corresponding virtual track blocks A,-H, (i=1, 2, or 3), respectively: Table 1 breaks-down the various codes for the scenario shown in FIG. 1:

TABLE 1

| | House 1 $A_1B_1C_1D_1E_1F_1G_1H_1$ | House 2 $A_2B_2C_2D_2E_2F_2G_2H_2$ | House 3 $A_3B_3C_3C_3E_3F_3G_3H_3$ |
|---|---|---|---|
| TC-A | 1 1 1 1 1 1 1 1 | 1 1 1 1 1 1 1 1 | 1 1 1 1 1 1 1 1 |
| TC-B | x x x x x x x x | x x x x x x x x | x x x x x x x x |
| VBP | 1 1 1 1 1 1 1 1 | 1 1 1 1 1 1 1 1 | 1 1 1 1 1 1 1 1 |

x = not transmitting or don't care

Figure 2:
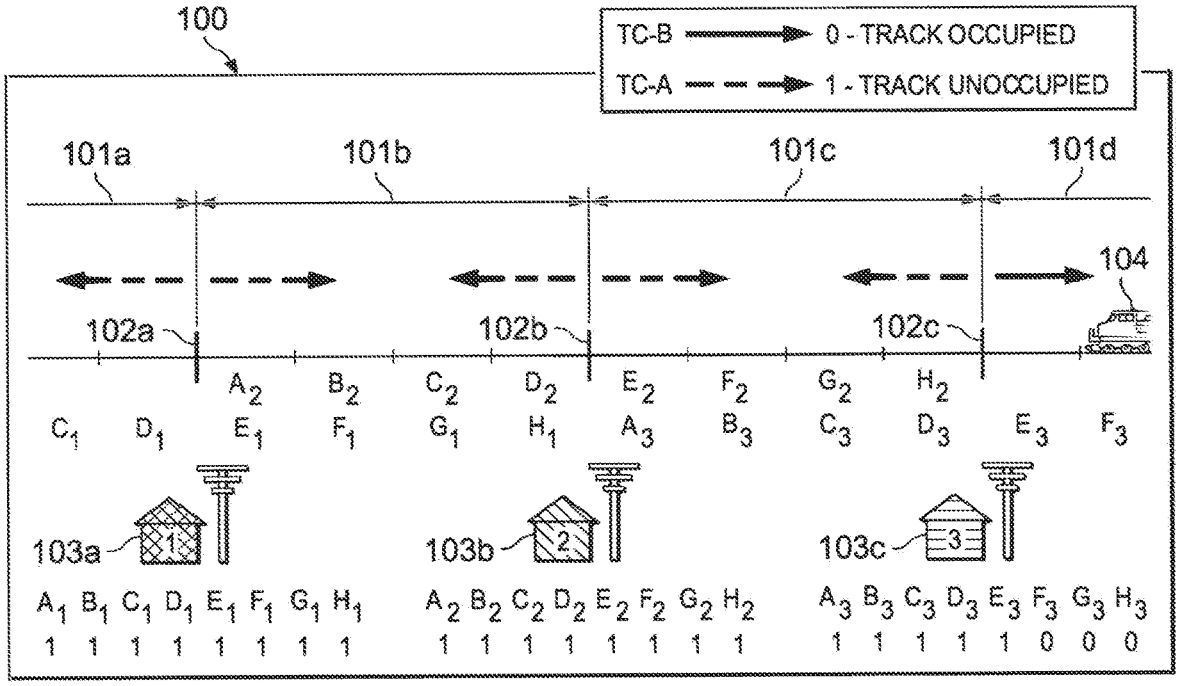
FIG. 2 is a diagram showing the system of FIG. 1, with a train approaching the rightmost signaling house.

FIG. 2 depicts the same track section with one train 104 entering from the right. At this time TC-A is transmitted between house #1 (103*a*) and house #2 (103*b*), with houses #1 and #2 generating and transmitting a VBP message of 11111111 for virtual track blocks $A_1$-$H_1$ and $A_2$-$H_2$, respectively. The same is true from house #2 (103*b*) to house #3 (103*c*). However, the right approach to house #3 (103*c*) is no longer receiving TC-A from the next house to its right (not shown), due to shunting by the train in physical track block 101*d*, and house #3 therefore ceases transmitting IC-A to the right. House #3 (103*c*) then begins to transmit TC-B to the right in order to determine the extent of occupancy within physical track block 101*d* (i.e., the virtual track block or blocks in which the train is positioned), conveyed as virtual track block(s) occupancy. In this case, house #3 (103*c*) determines that the train is within virtual track blocks $F_3$-$H_3$ of physical track block 101*d* and therefore generates a VBP message of 1111 (unoccupied) for virtual track blocks $A_3$-$D_3$ of physical track block 101*c* to its left and 1 (unoccupied) for virtual track block E3 of physical track block 101*d* to its right and 000 (occupied) for virtual track blocks $F_3$-$H_3$ of physical track block 101*d* to its right. Table 2 breaks-down the codes for the scenario shown in FIG. 2:

TABLE 2

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | 1 1 1 1 1 1 1 1 | 1 1 1 1 1 1 1 1 | 1 1 1 1 x x x x |
| TC-B | x x x x x x x x | x x x x x x x x | x x x x 1 0 0 0 |
| VBP | 1 1 1 1 1 1 1 1 | 1 1 1 1 1 1 1 1 | 1 1 1 1 1 0 0 0 |

x = not transmitting or don't care

Figure 3:
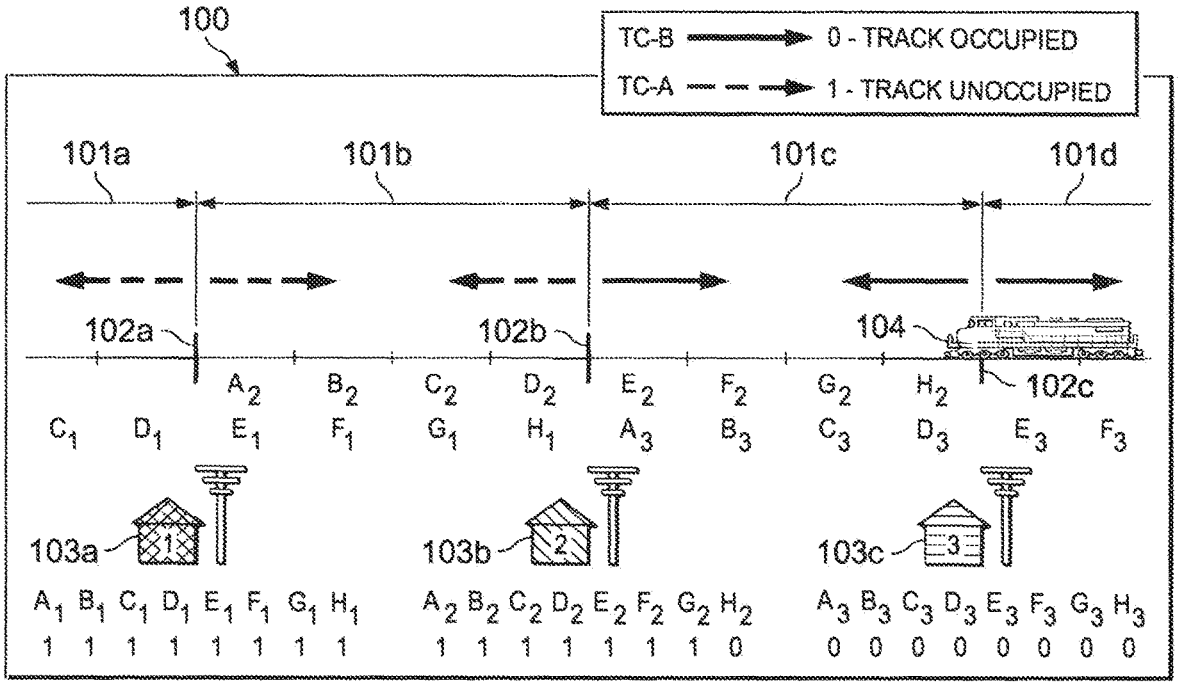
FIG. 3 is a diagram showing the system of FIG. 1, with the train entering the rightmost virtual track block between the rightmost and center signaling houses.

FIG. 3 depicts the same track section with the train now entering physical track block 101*c* between house #2 (103*b*) and house #3 (103*c*), while still occupying physical track block 101*d* to the right of house #3 (103*c*). At this time TC-A continues to be transmitted between the house #1 (10:3*a*) and house #2 (103*b*), with house #1 (103*a*) generating a VBP message of 11111111 for virtual track blocks $A_1$-$H_1$ and house #2 generating a VBP message of 1111111 for virtual track blocks $A_2$-$G_2$. However, the right approach of house #2 (103*b*) is no longer receiving TC-A from house #3 (103*c*), due to shunting by the train in physical track block 101*c*, and therefore house #2 ceases transmitting TC-A to the right. House #2 instead begins to transmit TC-B to the right in order to determine the extent of virtual track blocks occupied within physical track block 101*c*.

In particular, the train has entered virtual track block H2 of physical track block 101*c* and house #2 (103*b*) accordingly generates a 0 for virtual track block H2 in its VBP message. House #3 (103*c*) now generates and transmits a VBP message of 00000000 for virtual track blocks $A_3$-$H_3$, due to both sides of the insulated joint 102*c* being shunted within the nearest virtual track blocks. Table 3 breaks down the codes for the scenario of FIG. 3:

TABLE 3

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | 1 1 1 1 1 1 1 1 | 1 1 1 1 x x x x | x x x x x x x x |
| TC-B | x x x x x x x x | x x x x 1 1 1 0 | 0 0 0 0 0 0 0 0 |
| VBP | 1 1 1 1 1 1 1 1 | 1 1 1 1 1 1 1 0 | 0 0 0 0 0 0 0 0 |

x = not transmitting or don't care

Figure 4:
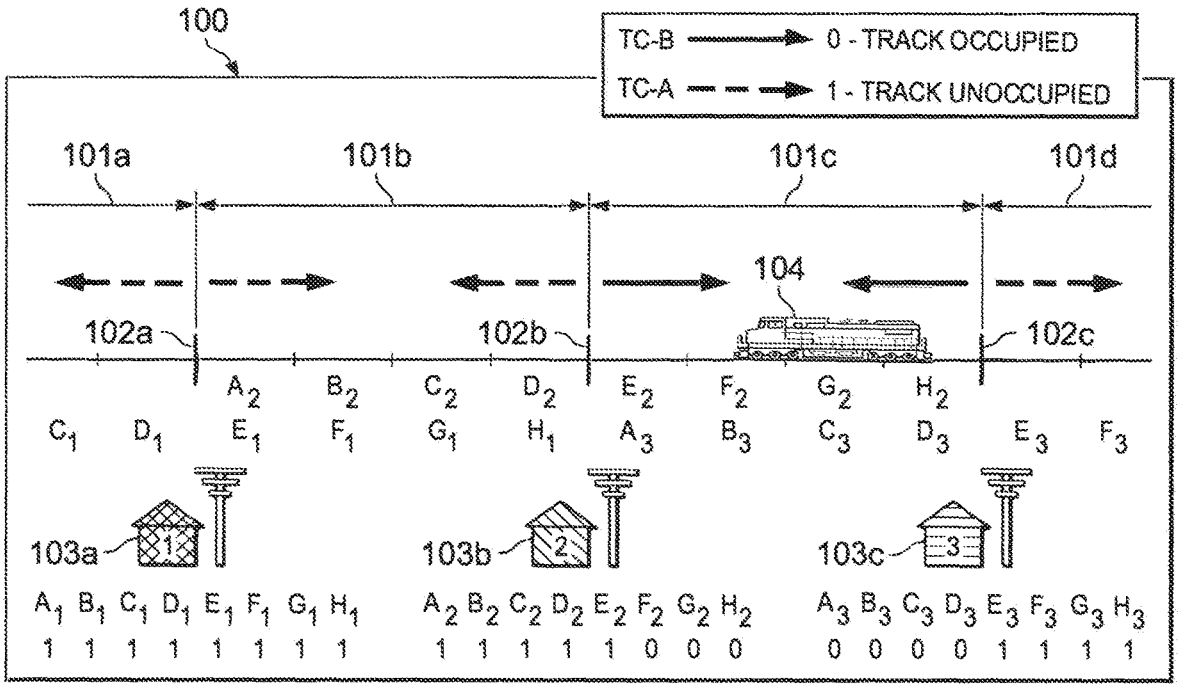
FIG. 4 is a diagram showing the system of FIG. 1, with the train positioned within the virtual track blocks between the rightmost and center signaling houses.

FIG. 4 depicts the same track section with the train now between house #2 (103*b*) and house #3 (103*c*). At this time, TC-A continues to be transmitted between house #1 (103*a*) and house #2 (103*b*), with house #1 generating a VBP message of 11111111 for virtual track blocks $A_1$-$H_1$ and house #2 generating a VBP message of 11111 for virtual track blocks A2-D2 The right approach of house #2 (103*b*) is still not receiving TC-A from house #3 (103*c*) and house

#2 therefore continues to transmit TC-B to the right to detect the virtual track block position of the train within physical track block 101*c*. With the train positioned within virtual track blocks $F_2$ Hz, house #2 (103*b*) generates and transmits a VBP message of 11111 for virtual track blocks Az-$E_2$ and 000 for virtual track blocks F2-H2.

House #3 (103*c*) transmits TC-B to the left and TC-A to the right since physical track block 101*d* is no longer occupied. Specifically, with the train positioned in virtual track blocks $B_3$-$D_3$, house #3 (103*c*) generates a VBP message of 0000 for virtual track blocks $A_3$-$D_3$ and 1111 for virtual track blocks $E_3$-$H_3$, Table 4 breaks-down the codes for the scenario of FIG. 4:

TABLE 4

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | 1 1 1 1 1 1 1 1 | 1 1 1 1 x x x x | 0 0 0 0 1 1 1 1 |
| TC-B | x x x x 1 1 1 1 | x x x x 1 0 0 0 | 0 0 0 0 x x x x |
| VBP | 1 1 1 1 1 1 1 1 | 1 1 1 1 1 0 0 0 | 0 0 0 0 1 1 1 1 |

x not transmitting or don't care

Figure 5:
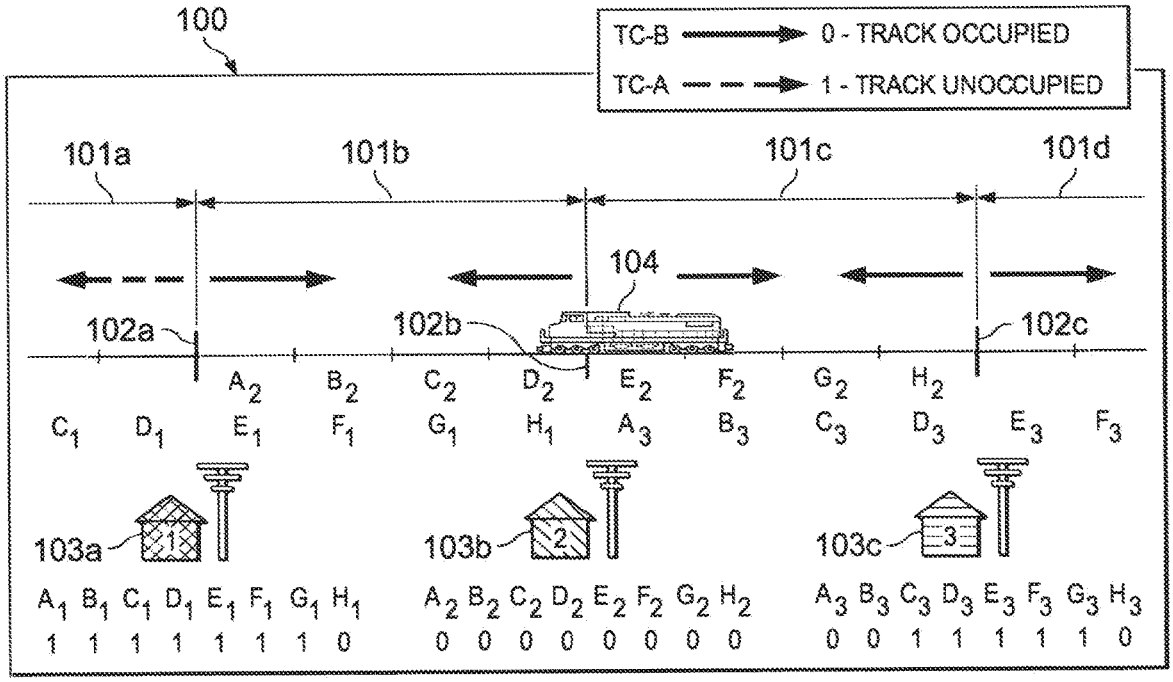
FIG. 5 is a diagram showing the system of FIG. 1, with the train entering the rightmost virtual track block between the center signaling house and the leftmost signaling house.

FIG. 5 depicts the same track section with the train now in physical track block 101*b* between house #1 (103*a*) and house #2 (103*b*), as well as in physical track block 101*c* between house #2 (103*b*) and house #3 (103*c*). Both house #1 and house #3 use TC-B signaling to determine train virtual track block position, with house #1 determining the train position to be within virtual track block $H_1$ and house #3 determining the train position to be within virtual track blocks $A_3$-$B_3$. With the train in virtual track block $H_1$, house #1 (103*a*) generates a VBP message consisting of 1111111 for virtual track blocks $A_1$-$G_1$ and 0 for virtual track block $H_1$. House #2 (103*b*) generates a VBP message of 00000000 for virtual track blocks Az-Hz, due to both sides of insulated joint 102*b* being shunted within the nearest virtual track blocks.

The left approach of house #3 (103*c*) is still not receiving TC-A from house #2 (103*b*) and continues to transmit TC-B to the left to determine the virtual track block position of the train within physical track block 101*c*, which in this case is virtual track blocks $A_3$-$B_3$. House #3 (103*c*) also transmits TC-B to the right as well, since physical track block 101*d* to the right is no longer receiving TC-A from the house to its right (not shown). This indicates a second train is on the approach to house #3 (103*c*) from the right. House #3 (103*c*) accordingly generates a VBP message of 00 for virtual track blocks $A_3$-$B_3$. 11111 for virtual track block $C_3$-$G_3$, and 0 for virtual track block H3. Table 5 breaks-down the codes for the scenario of FIG. 5:

TABLE 5

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | 1 1 1 1 x x x x | x x x x x x x x | x x x x x x x x |
| TC-B | x x x x 1 1 1 1 | 0 0 0 0 0 0 0 0 | 0 0 1 1 1 1 1 0 |
| VBP | 1 1 1 1 1 1 1 0 | 0 0 0 0 0 0 0 0 | 0 0 1 1 1 1 1 0 |

x not transmitting or don't care

Figure 6:
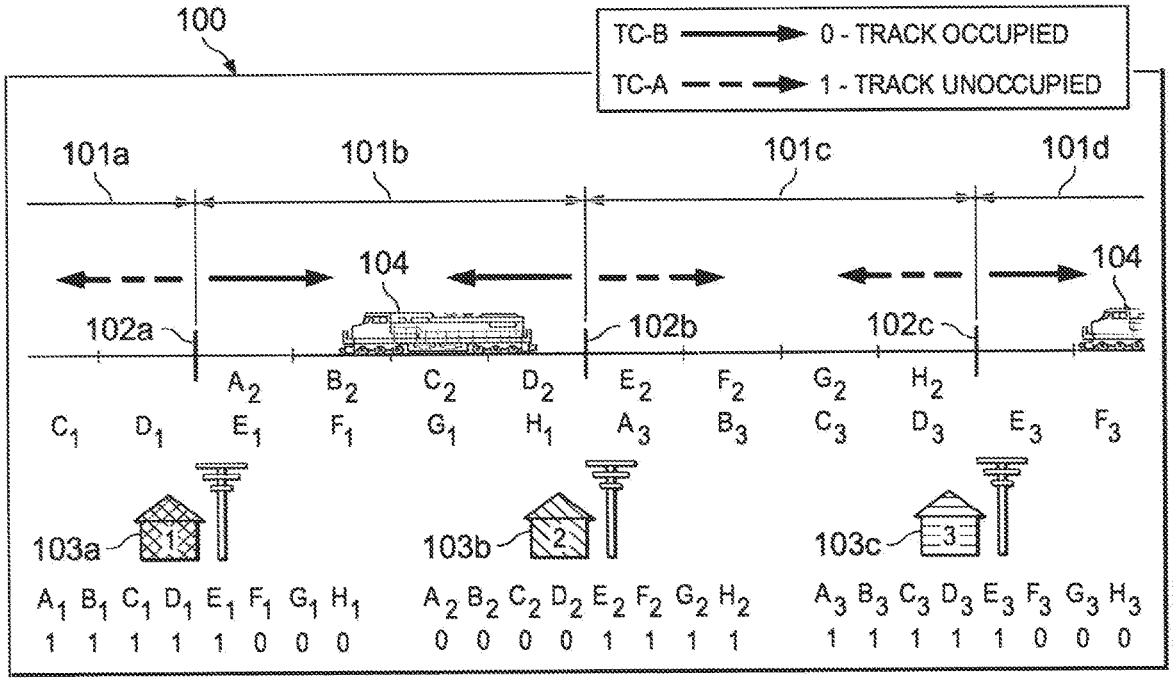
FIG. 6 is a diagram showing the system of FIG. 1, with the train positioned within the virtual track blocks between the center and leftmost signaling houses and a second following train approaching the rightmost signaling house.

FIG. 6 depicts the same track section with the first train between the house #1 (103*a*) and house #2 (103*b*) and the second train on the right approach to house #3 (103*c*). Both house #1 and house #2 combined use TC-B signaling to determine train virtual track block position for the first train to be within virtual track blocks $B_2$-$D_2$. House #1 (103*a*) therefore generates a VBP message consisting of 11111 for virtual track blocks $A_1$-$E_1$ and 000 for virtual track blocks $F_1$-$H_1$. House #2 (103*b*) generates a VBP message of 0000 for virtual track block A2 and 1111 for virtual track blocks $E_2$-H2.

The right approach of house #2 (103*b*) and the left approach of house #3 (103*c*) are now transmitting and receiving TC-A signals. House #3 (103*c*) continues to transmit TC-B to the right and detects the second train within virtual track blocks $F_3$-$H_3$ of physical track block 101*d*. House #3 (103*c*) therefore generates a VBP message of 11111 for virtual track blocks $A_3$-$E_3$ and 000 for virtual track blocks $F_3$-$H_3$. Table 6 breaks-down the codes for the scenario of FIG. 6:

TABLE 6

| | House 1 $A_1B_1C_1D_1F_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | 1 1 1 1 x x x x | x x x x 1 1 1 1 | 1 1 1 1 x x x x |
| TC-B | x x x x 1 0 0 0 | 0 0 0 0 x x x x | x x x x 1 0 0 0 |
| VBP | 1 1 1 1 1 0 0 0 | 0 0 0 0 1 1 1 1 | 1 1 1 1 1 0 0 0 |

x not transmitting or don't care

Figure 7:
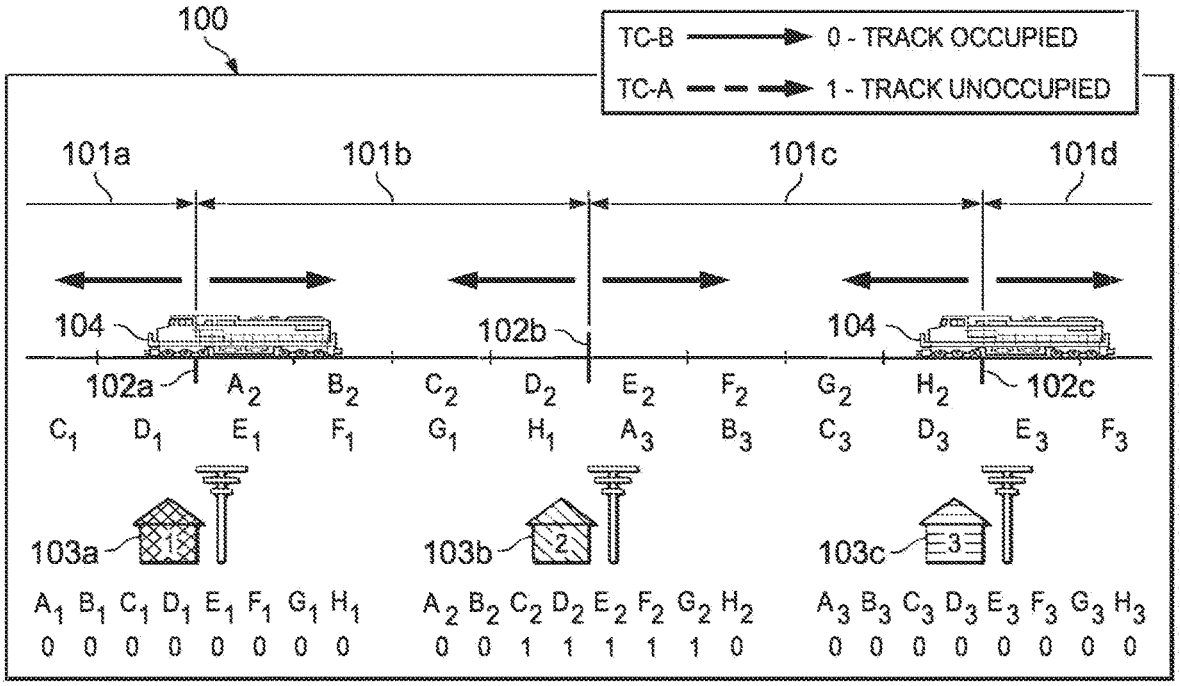
FIG. 7 is a diagram showing the system of FIG. 1, with the first train moving out of the physical track block between the center and leftmost signaling houses and the second train entering the physical track block between the center and rightmost signaling houses.

FIG. 7 depicts the same track section with the first train now within physical track block 101*a* between the house to the left of House #1 (103*a*) (not shown) and house 41, as well as within physical track block 101*b* between house #1 (103*a*) and house #2 (103*b*). House #1 (103*a*) detects the presence of the first train using IC B signaling and generates and transmits a VBP message consisting of 00000000 for virtual track blocks due to both sides of insulated joint 102*a* being shunted within the nearest virtual track blocks. The left approach of house #2 (103*b*) is still not receiving TC A from house #1 (103*a*), due to shunting by the first train, and house #2 therefore continues to transmit TC-B to the left. House #2 (103*b*) now transmits TC-B to the right as well, since physical track block 101*c* to the right is no longer receiving TC-A from house #3 (103*c*), due to shunting by the second train.

Specifically, from the TC B signaling, house #2 detects the first train within virtual track blocks $A_2$-$B_2$, virtual track blocks $C_2$-$G_2$ as unoccupied, and the second train within virtual track block $H_2$. House #2 (103*b*) therefore generates and transmits a VBP message of 00 for virtual track blocks $A_2$-$B_2$, 11111 for virtual track blocks $C_2$-$G_2$, and 0 for virtual track block H2. The second train is now in physical track block 101*c* between house #2 (103*b*) and house #3 (103*c*), as well as in physical track block 101*d* between house #3 (103*c*) and the house to the right of house #3 (103*c*) (not shown). In this case, house #3 (103*c*) generates a VBP message of 00000000 for virtual track blocks $A_3$-$H_3$, due to both sides of insulated joint 102*c* being shunted within the nearest virtual track blocks. Table 7 breaks-down the codes for the scenario of FIGURE

TABLE 7

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | x x x x x x x x | x x x x x x x x | x x x x x x x x |
| TC-B | 0 0 0 0 0 0 0 0 | 0 0 1 1 1 1 1 0 | 0 0 0 0 0 0 0 0 |
| VBP | 0 0 0 0 0 0 0 0 | 0 0 0 1 1 1 1 0 | 0 0 0 0 0 0 0 0 |

x not transmitting or don't care

Figure 8:
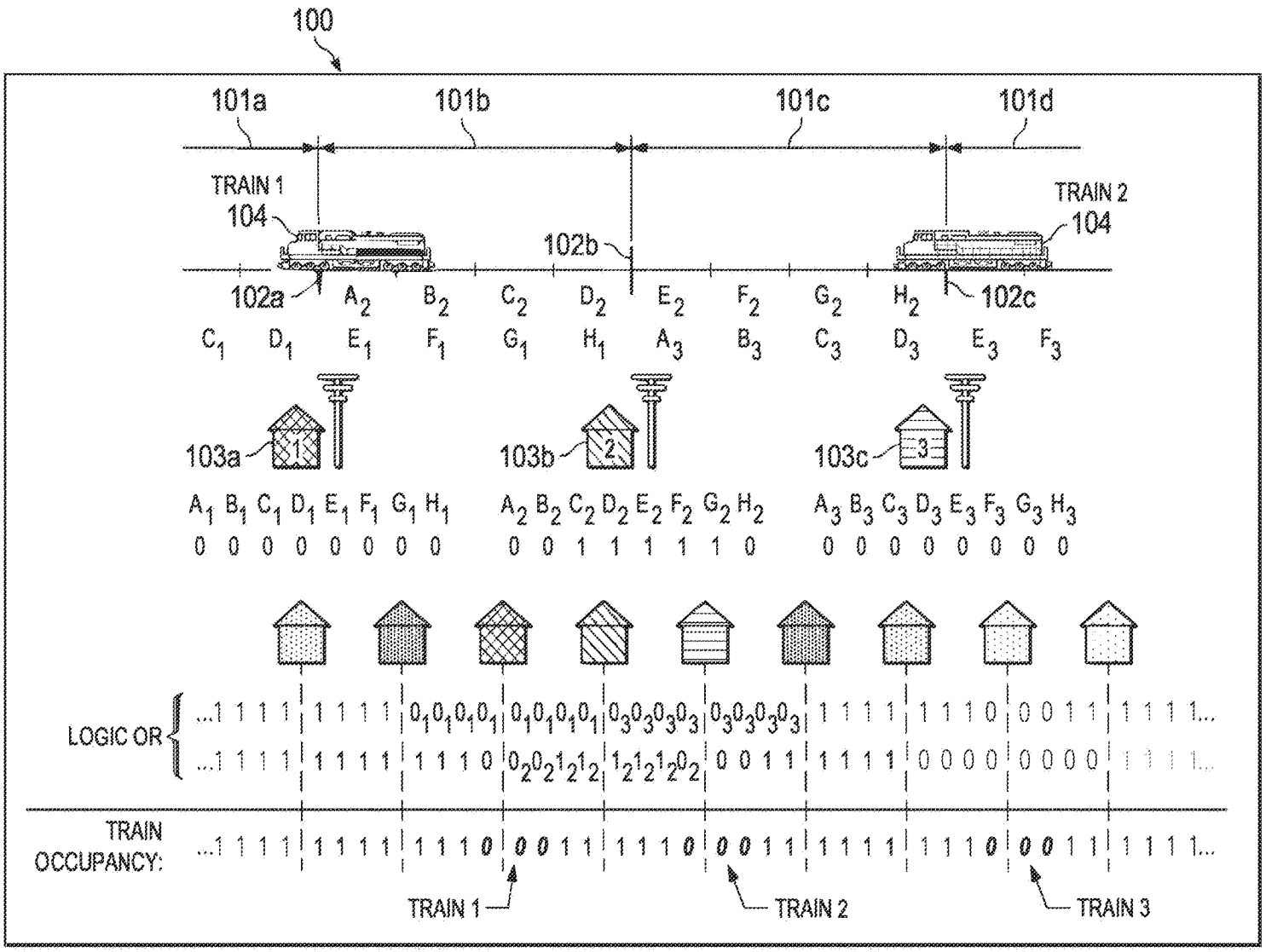
FIG. 8 is a diagram showing the scenario of FIG. 7, along with the processing of the corresponding message codes onboard any locomotives within the vicinity of at least one of the depicted signaling houses.

FIG. 8 depicts the combining of multiple wayside occupancy indications into one common view of train occupancy.

In the illustrated embodiment, the left four virtual track blocks of each house overlap the right four virtual track blocks of the adjacent house. The same is true for the right side of each house respectively. If the wayside data is aligned as shown FIG. 8 and a logical OR is applied, the train occupancy can be determined to the nearest occupied virtual track block. In other words, any train in the vicinity that receives the VBP codes can determine the position of any other trains within the vicinity, without the need for aspect signaling. Table 8 breaks-down the codes for the scenario of FIG. 8:

TABLE 8

| | House 1 $A_1B_1C_1D_1E_1F_1G_1H_1$ | House 2 $A_2B_2C_2D_2E_2F_2G_2H_2$ | House 3 $A_3B_3C_3D_3E_3F_3G_3H_3$ |
|---|---|---|---|
| TC-A | x x x x x x x x | x x x x x x x x | x x x x x x x x |
| TC-B | 0 0 0 0 0 0 0 0 | 0 0 1 1 1 1 1 0 | 0 0 0 0 0 0 0 0 |
| VBP | 0 0 0 0 0 0 0 0 | 0 0 1 1 1 1 1 0 | 0 0 0 0 0 0 0 0 |

x = not transmitting or don't care

According to the principles of the present invention, determining whether a virtual track block is occupied or unoccupied can be implemented using any one of a number of techniques. Preferably, existing vital logic controllers and track infrastructure are used, and the system interfaces with existing Electrocode equipment when determining if a virtual track block is unoccupied.

In the illustrated embodiment, the system differentiates between virtual track blocks that are 25% increments of the standard physical track blocks, although in alternate embodiments physical track blocks may be partitioned into shorter or longer virtual track blocks. In addition, in the illustrated embodiment, in the event of a broken rail under a train, the vital logic controller records, sets alarms, and indicates the location of the broken rail to the nearest virtual track block (25% increment of the physical track block).

Preferably, the system detects both the front (leading) and rear (trailing) axles of the train and has the ability to detect and validate track occupancy in approach and advance. The present principles are not constrained by any particular hardware system or method for determining train position, and any one of a number of known methods can be used, along with conventional hardware.

For example, wheel position may be detected using currents transmitted from one end of a physical track block towards the other end of the physical track block and shunted by the wheel of the train. Generally, since the impedance of the track is known, the current transmitted from an insulated joint will be proportional to the position of the shunt along the block, with current provide from in front of the train detecting the front wheels and current provided from the rear of the train detecting the rear wheel. Once the train position is known, the occupancy of the individual virtual track blocks is also known. While either DC or AC current can be used to detect whether a virtual track block is occupied or unoccupied, if an AC overlay is utilized, the AC current is preferably less than 60 Hz and remains off until track circuit is occupied.

In addition, train position can be detected using conventional railroad highway grade crossing warning system hardware, such as motion sensors. Moreover, non-track related techniques may also be used for determining train position, such as global positioning system (GPS) tracking, radio frequency detection, and so on.

In the illustrated embodiment, the maximum shunting sensitivity is 0.06 Ohm, the communication format is based on interoperable train control (ITC) messaging, and monitoring of track circuit health is based upon smooth transition from 0-100% and 100-0%.

In the preferred embodiment, power consumption requirements comply with existing wayside interface unit (WW) specifications. Logging requirements include percentage occupancy, method of determining occupancy, and direction at specific time; message transmission contents and timing; calibration time and results; broken rail determinations; error codes; and so on.

The embodiment described above is based on a track circuit maximum length of 12,000 feet, which is fixed (i.e., not moving), although the track circuit maximum length may vary in alternate embodiments. Although the bit description describe above is a 1 for an unoccupied virtual track block and 0 for an occupied virtual track block, the inverse logic may be used in alternate embodiments.

One technique for measuring track position and generating TC-B is based on currents transmitted from one end of a physical track block towards the other end of the physical track block and shunted by the wheels of the train. Generally, since the impedance of the track is known, the current transmitted from an insulated joint will be proportional to the position of the shunt along, the block. Once the train position is known, the occupancy of the individual virtual track blocks is also known.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A railroad track control system for maintaining a braking distance onboard a locomotive comprising:

a plurality of control systems each disposed at a corresponding end of a corresponding physical track block, each control system operable to:

detect an electrical circuit discontinuity in the corresponding physical track block;

detect a presence of a train within the corresponding physical track block;

determine an occupancy of the train within at least one virtual track block of a plurality of virtual track blocks within the corresponding physical track block; and transmit a virtual track block position (VBP) message identifying the occupancy of at least one virtual track block within the corresponding physical track block to the locomotive.

2. The railroad track control system of claim 1, wherein the virtual track block position (VBP) message represents the occupancy data determined from the TC-A and TC-B signals.

3. The railroad track control system of claim 1, wherein each control system is operable to detect the presence of the train within the corresponding physical track block by detecting an interruption of a track signal transmitted by another one of the control systems disposed at an opposing end of the corresponding physical track block.

4. The railroad track control system of claim 3, wherein the track signal comprises a track code.

5. The railroad track control system of claim 1, wherein each control system is operable to determine the occupancy of the train within the at least one virtual track block within the corresponding physical track block by transmitting a track signal along the corresponding physical track block and receiving the track signal returned from wheels of the train.

6. The railroad track control system of claim 1, wherein each control system is operable to wirelessly transmit the VBP message identifying the occupancy of the train within the at least one virtual track block.

7. The railroad track control system of claim 1, wherein each control system is operable to transmit a code identifying the occupancy of the train having a least one bit corresponding to one of a plurality of virtual track blocks within the corresponding physical track block.

8. The railroad track control system of claim 1, wherein transmission of TC-B signals determines the extent of occupancy within physical track block.

9. The railroad track control system of claim 1, wherein TC-B signals are implemented as a reflection of transmitted energy using a transceiver pair with separate components.

10. A method of railroad track control for maintaining a braking distance onboard a locomotive, comprising:

detecting an electrical circuit discontinuity in the corresponding physical track block;

detecting a presence of a train within the corresponding physical track block;

determining an occupancy of the train within at least one virtual track block of a plurality of virtual track blocks within the corresponding physical track block; and transmitting a virtual track block position (VBP) message identifying the occupancy of at least one virtual track block within the corresponding physical track block to the locomotive.

11. The method of claim 10, wherein the virtual track block position (VBP) message represents the occupancy data determined from the TC-A and TC-B signals.

12. The method of claim 10, wherein each control system is operable to detect the presence of the train within the corresponding physical track block by detecting an interruption of a track signal transmitted by another one of the control systems disposed at an opposing end of the corresponding physical track block.

13. The method of claim 12, wherein the track signal comprises a track code.

14. The method of claim 12, wherein each control system is operable to determine the occupancy of the train within the at least one virtual track block within the corresponding physical track block by transmitting a track signal along the corresponding physical track block and receiving the track signal returned from wheels of the train.

15. The method claim 10, wherein each control system is operable to wirelessly transmit the VBP message identifying the occupancy of the train within the at least one virtual track block.

16. The method of claim 10, wherein each control system is operable to transmit a code identifying the occupancy of the train having a least one bit corresponding to one of a plurality of virtual track blocks within the corresponding physical track block.

* * * * *